US012372337B1

(12) United States Patent
Scheunert et al.

(10) Patent No.: US 12,372,337 B1
(45) **Date of Patent: *Jul. 29, 2025**

(54) PRECISION NON-SHATTERING LESS-LETHAL PROJECTILE

(71) Applicant: Umarex GmbH & Co. KG, Arnsberg (DE)

(72) Inventors: Thomas Scheunert, Arnsberg (DE); Eyck Pflaumer, Arnsberg (DE); Richard Turner, Fayetteville, AR (US)

(73) Assignee: Umarex GmbH & Co. KG, Arnsberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 19/040,324

(22) Filed: Jan. 29, 2025

Related U.S. Application Data

(63) Continuation of application No. PCT/IB2024/050955, filed on Feb. 1, 2024, which is (Continued)

(51) Int. Cl.
*F42B 12/36* (2006.01)
*F41B 11/80* (2013.01)

(Continued)

(52) U.S. Cl.
CPC ..... *F42B 12/36* (2013.01); *F42B 8/12* (2013.01); *F42B 8/16* (2013.01); *F42B 10/04* (2013.01);

(Continued)

(58) Field of Classification Search
CPC ..... F42B 12/34; F42B 12/36; F42B 12/367; F42B 12/40; F42B 12/46; F42B 12/50;

(Continued)

(56) References Cited

U.S. PATENT DOCUMENTS 3,650,213 A * 3/1972 Abbott ..... F42B 12/50 102/444
4,128,059 A 12/1978 Black (Continued)

FOREIGN PATENT DOCUMENTS

WO WO-2024218577 A1 * 10/2024 ..... F42B 12/50

OTHER PUBLICATIONS

International Search Report in PCT/IB2024/050955, published as WO 2024218577, mailed Oct. 24, 2024.

(Continued)

*Primary Examiner* — James S Bergin
(74) *Attorney, Agent, or Firm* — Eric B. Fugett; Mark A. Pitchford; Pitchford Fugett, PLLC

(57) ABSTRACT

A less-lethal projectile include a rear portion and a front portion. The rear portion can be a base member having a head, a waist, and a skirt configured to obturate a rifled barrel bore of an airgun. The front portion can be a hollow cylindrical cap sealingly engaged with the head such that the cap and the base member define an interior cavity in which a payload is received. The cap can include a plurality of fins and grooves configured to stabilize the projectile during flight toward a target and open without shattering the cap to release the payload from the cavity upon impact of the projectile with the target.

19 Claims, 11 Drawing Sheets

Related U.S. Application Data a continuation of application No. 18/500,355, filed on Nov. 2, 2023, now Pat. No. 12,025,415.

(60) Provisional application No. 63/459,607, filed on Apr. 15, 2023.

(51) Int. Cl.

| | |
|---|---|
| ***F42B 8/12*** | (2006.01) |
| ***F42B 8/16*** | (2006.01) |
| ***F42B 8/18*** | (2006.01) |
| ***F42B 10/04*** | (2006.01) |
| ***F42B 12/40*** | (2006.01) |
| ***F42B 12/46*** | (2006.01) |
| ***F42B 30/02*** | (2006.01) |
| *F42B 14/00* | (2006.01) |

(52) U.S. Cl.
CPC ..... *F42B 12/46* (2013.01); *F42B 30/02* (2013.01); *F41B 11/80* (2013.01); *F42B 12/40* (2013.01); *F42B 14/00* (2013.01)

(58) Field of Classification Search
CPC ..... F42B 12/52; F42B 12/745; F42B 8/12; F42B 8/14; F42B 8/16; F42B 8/18; F41B 11/00; F41B 11/80; F41B 11/81
USPC ..... 102/502
See application file for complete search history.

(56) References Cited

U.S. PATENT DOCUMENTS

| | | | | |
|---|---|---|---|---|
| 5,035,183 | A | 7/1991 | Luxton | |
| 5,133,261 | A | 7/1992 | Kelsey, Jr. | |
| 5,791,327 | A | 8/1998 | Riggs | |
| 6,497,181 | B1 | 12/2002 | Manole | |
| 6,615,739 | B2 | 9/2003 | Gibson | |
| 7,143,699 | B2 | 12/2006 | Brock | |
| 7,222,573 | B2 | 5/2007 | Pontieri | |
| 7,526,998 | B2 | 5/2009 | Vasel | |
| 7,690,311 | B1 * | 4/2010 | Cronemberger | F42B 12/40 102/512 |
| 8,875,634 | B2 | 11/2014 | Gibson | |
| 9,157,715 | B1 | 10/2015 | Lafortune | |
| 9,494,397 | B2 | 11/2016 | Carlson | |
| 9,746,297 | B2 * | 8/2017 | Buys | F42B 14/06 |
| 9,784,540 | B2 | 10/2017 | Macy | |
| 10,295,319 | B2 | 5/2019 | Gibson | |
| 10,883,807 | B2 | 1/2021 | Dwire | |
| 11,280,598 | B2 | 3/2022 | Kralj | |
| 11,287,235 | B2 | 3/2022 | Lafortune | |
| 11,609,072 | B2 | 3/2023 | Willson | |
| 11,808,552 | B1 | 11/2023 | Italia | |
| 12,025,415 | B1 * | 7/2024 | Scheunert | F42B 8/12 |
| 2009/0101038 | A1 | 4/2009 | Kapeles | |

OTHER PUBLICATIONS

Written Opinion of International Searching Authority in PCT/IB2024/050955, published as WO 2024218577, mailed Oct. 24, 2024.

* cited by examiner

PRECISION NON-SHATTERING LESS-LETHAL PROJECTILE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This non-provisional application claims priority to and is a bypass continuation of co-pending PCT Application No. PCT/IB2024/050955, filed Feb. 1, 2024 and entitled "PRECISION NON-SHATTERING LESS-LETHAL PROJECTILE," which was internationally published on Oct. 24, 2024 as WO 2024/218577, designates the United States, and claims priority to U.S. Non-provisional patent application Ser. No. 18/500,355, filed Nov. 2, 2023 and entitled "PRECISION NON-SHATTERING LESS-LETHAL PROJECTILE," which issued as U.S. Pat. No. 12,025,415 on Jul. 2, 2024, and which claims priority to U.S. Provisional Patent Application No. 63/459,607, filed Apr. 15, 2023 and entitled "AIRGUN WITH PREDETERMINED IMPACT ENERGY AND PRECISION NONSHATTERING PROJECTILE," the entire disclosure of each of which is hereby incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to projectiles. More particularly, this invention relates to less-lethal projectiles for airguns.

Weapons designed to minimize injury or death are widely known as "non-lethal," or more accurately, "less-lethal" weapons. Ranged less-lethal weapons typically use one or more compressed gasses as a propellant to fire or launch projectiles specifically designed to mark, elicit behavioral modification from, or even incapacitate a target without the typically lethal or permanent lasting effects of conventional firearms loaded with traditional metal ammunition. Like the weapons from which they are launched, such projectiles are known as "less-lethal" projectiles. Less-lethal projectiles are used around the world by civilians, law enforcement, and military personnel in a wide variety of applications, including self-defense, shooting sports and games, training, riot control, crowd control, prisoner control, and area denial, to name but a few.

Numerous types of less-lethal projectiles are known. These include tear gas and smoke canisters, rubber bullets, bean bag rounds, paintballs, and pepper spray projectiles, among others. However, tear gas and smoke canisters, and the like, are indiscriminate and often cannot be used to deter specifically targeted persons without affecting an entire group. Rubber bullets and bean bag rounds are purely kinetic projectiles which function by delivering a blunt impact that actuates pain receptors in a living target to elicit behavioral change and some degree of incapacitation. Currently available rubber bullets and bean bag rounds are notoriously inaccurate, and are thus not suitable for precision targeting of a single individual in a crowd.

By contrast, paintballs are light-weight, spherical gelatin capsules containing primarily polyethylene glycol, other non-toxic and water-soluble substances, and dye. The gelatin shell of a paintball is designed to break upon impact and release the paint contained therein, thereby marking the target with the dye. Although paintballs do typically cause some degree of physical discomfort upon impact, they are primarily used by civilians and law enforcement alike for target marking purposes, whether in furtherance of recreational or policing activities. Being both spherical and gelatinous, paintballs travel at relatively low velocities and are therefore subject to certain range limitations beyond which their accuracy and usefulness drops off dramatically.

Unlike paintballs, pepper spray projectiles are frangible projectiles comprising a hollow shell or capsule which contains a chemical irritant designed to irritate the eyes and nose in a manner similar to pepper spray. Widely known as "pepper balls," pepper spray projectiles are most often spherical, but can also come in other shapes. The irritant payload is usually a flowable powder or a liquid, but can also be a gel, gas, or aerosol. For example, many available pepper balls are substantially filled with powdered or liquid capsaicin, the active ingredient in pepper spray, or some derivative or analog thereof. Other forms of pepper ball projectiles include those with an inert dummy payload used for training and testing purposes. Pepper balls can be and are typically fired at a higher velocity than paintballs because the shells of pepper balls are not made from gelatin, but rather a thicker, rigid frangible plastic. This helps the pepper balls fly straighter and farther, thereby providing better accuracy and range than paintballs. Pepper balls are immediately painful on impact with organic tissue, at which point the shells thereof shatter and disperse the irritant with similar effect to aerosol-delivered pepper spray.

However, currently available pepper spray projectiles of all shapes and sizes are notoriously inaccurate, at least in part because they cannot be reliably fired from a weapon with a rifled barrel bore. In addition, many pepper spray projectiles do not reliably break upon impact with soft tissue or clothing, which dramatically limits their effective range and usefulness. This is at least partially because current manufacturing techniques do not allow for the shell or capsule of a pepper spray projectile to be completely filled with the irritant payload. The unavoidable result is that at least a small amount of empty void space remains inside the shell or capsule. This disadvantageously allows the flowable payload to move around inside the projectile, which not only creates imbalance and prevents the projectile from flying straight (i.e., "true") when shot at a target, but also cushions the impact and inhibits breaking. Because the irritant payload must contact the eyes, nose, or mouth of the target to have the intended effective, these drawbacks combine to severely limit the usefulness of pepper spray-type projectiles to applications where the shooter will be undesirably close to the potential target(s) and/or the target(s) are not likely to be wearing thick clothing or protective gear.

Even when pepper spray projectiles do reliably break upon impact, they tend to shatter (i.e., explosively fragment) into many small pieces that spread at high velocity like shrapnel in all directions from the site of impact. This risks both accidental application of the chemical irritant to untargeted bystanders and, moreover, permanent damage to their eyes and other sensitive areas. To minimize these risks, many law enforcement officers intentionally aim pepper spray projectiles at the ground near a target. However, doing so undesirably eliminates the appreciable deterrent and incapacitating effect on the target of the kinetic impact of the projectile, which reduces the overall efficacy and usefulness of the projectile.

Accordingly, what is needed are improvements in less-lethal projectiles.

BRIEF SUMMARY OF THE INVENTION

This Brief Summary is provided to introduce a selection of concepts in a simplified form that are further described below in the Detailed Description. This Brief Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

The present invention provides a novel precision non-shattering (i.e., non-frangible) less-lethal projectile for airguns. The non-spherical projectile includes a front portion in the form of a non-metallic hollow cylindrical cap, and a rear portion in the form of a non-metallic base member. The base member is shaped and sized to obturate (i.e., substantially seal) a rifled barrel bore of an airgun when fired from the airgun, as well as center and stabilize the projectile during travel down the bore. The cap at least partially defines an interior cavity of the projectile in which a flowable payload is received through a fill aperture extending longitudinally through the base member. A plug received in the fill aperture seals the flowable payload within the cavity. A plurality of alternating fins and grooves on the cap collectively define a serrated concave meplat that stabilizes the projectile during flight toward a target and opens without shattering the cap upon impact of the projectile with the target. Impact of the meplat with the target causes the cap to split or tear along one or more grooves and release the payload from the cavity. This applies the flowable payload solely and directly to the target without generating potentially injurious flying fragments, thereby providing increased precision, reliability, and safety relative to currently available less-lethal projectiles.

Accordingly, in one aspect, the invention provides a less-lethal projectile comprising a rear portion configured to obturate a barrel bore of the airgun and a front portion at least partially defining an interior cavity in which a flowable payload is receivable. The front portion is configured to open without shattering and release the payload from the cavity upon impact of the projectile with a target. The rear portion of the projectile can be a generally diabolo-shaped base member defining a longitudinal axis and including a waist, a head at a forward end of the waist, and a skirt at a rear end of the waist. The front portion of the projectile can be a hollow cylindrical cap on which is formed a plurality of fins configured to stabilize the projectile during flight toward the target and open the cap upon impact.

In another aspect, the invention provides a less-lethal projectile, comprising a rear portion defining a longitudinal axis and a front portion defining a plurality of fins configured to stabilize the projectile during flight toward a target. The front portion can be a cylindrical cap in which is disposed a non-flowable payload. The cap can include a plurality of fins configured to stabilize the projectile during flight toward the target.

In yet another aspect, the invention provides a less-lethal projectile comprising a polymeric base member including a cylindrical trunk defining a longitudinal axis, a flange at a forward end of the trunk, a skirt at a rear end of the trunk, and a fill aperture extending through the base member coaxially with the longitudinal axis; a polymeric hollow cylindrical cap connected to the flange, the cap at least partially defining an interior cavity; a flowable payload received in the cavity; a plug configured to seal the payload in the cavity received in the fill aperture; wherein the cap is configured to release the payload from the cavity without shattering upon impact of the projectile with a target.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

Reference will now be made in detail to optional embodiments of the invention, examples of which are illustrated in accompanying drawings. Whenever possible, the same reference numbers are used in the drawings and in the description referring to the same or like parts.

DETAILED DESCRIPTION OF THE INVENTION

Figure 1:
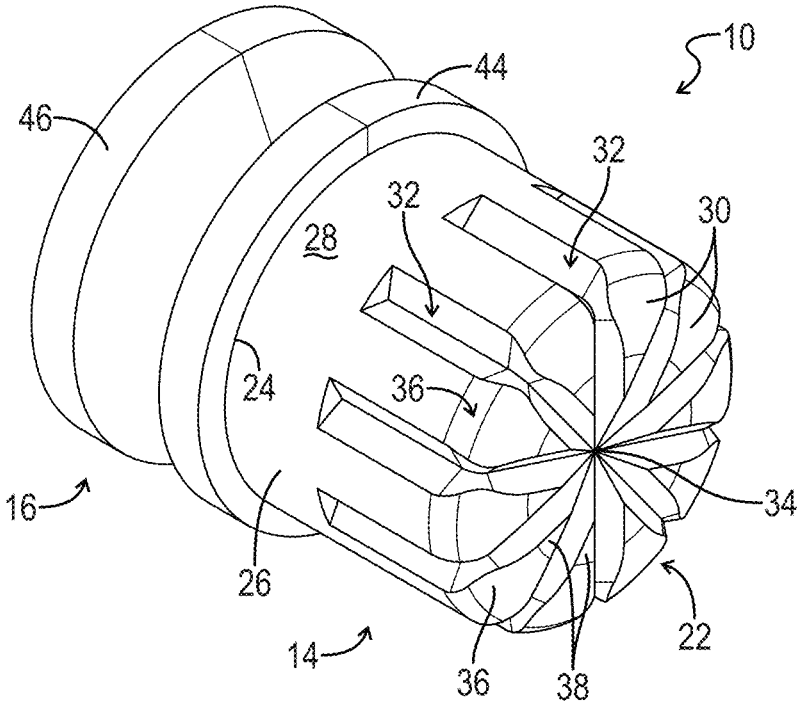
FIG. 1 is an elevated front right side perspective view of an embodiment of a precision non-shattering projectile constructed in accordance with the present invention.
Figure 2:
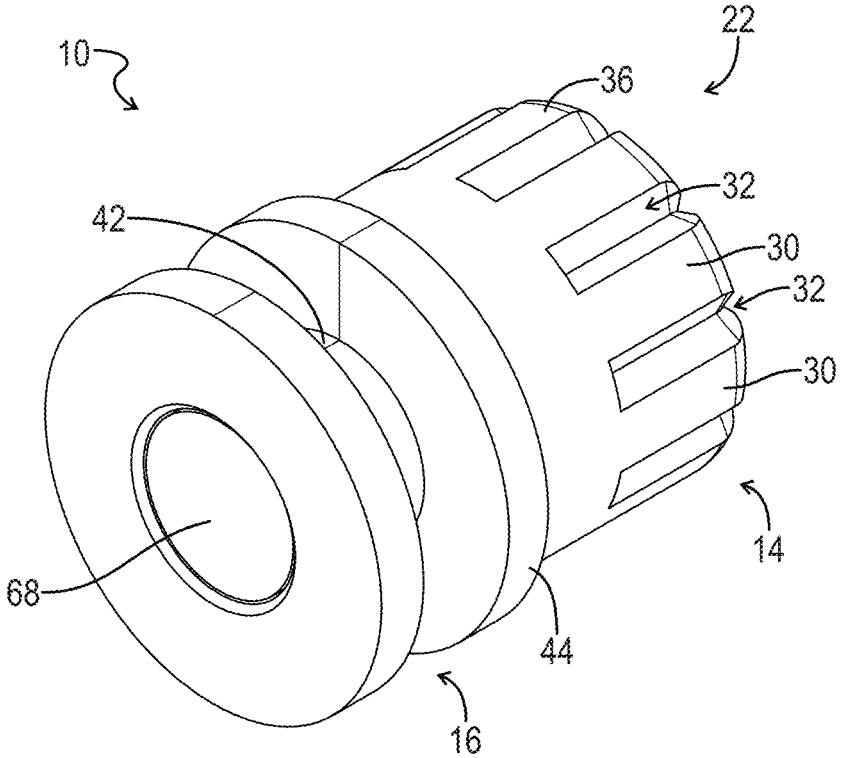
FIG. 2 is an elevated rear right side perspective view of the projectile of FIG. 1.
Figure 3:
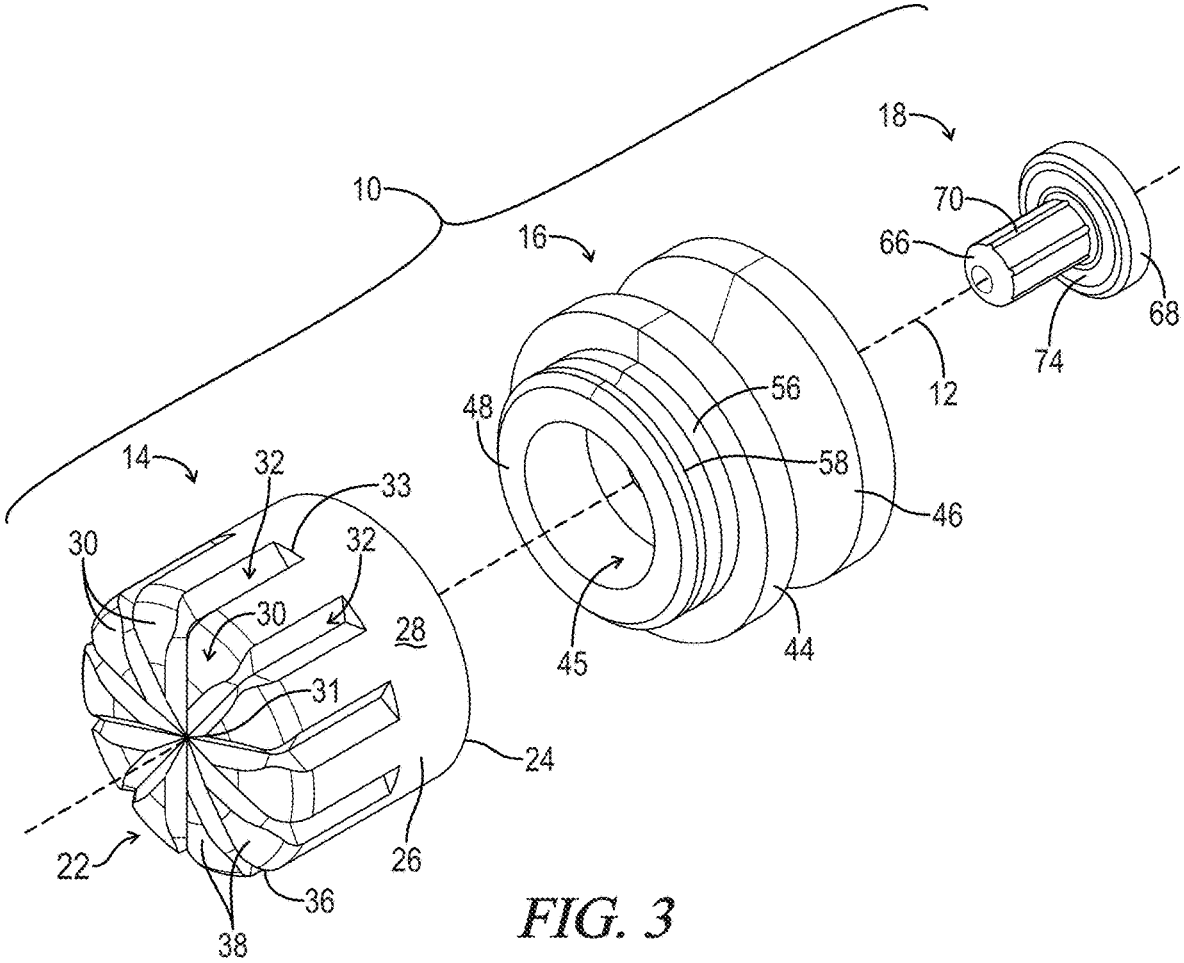
FIG. 3 is an elevated front left side exploded perspective view of the projectile of FIG. 1. The payload contained within the interior cavity has been omitted for clarity.
Figure 4:
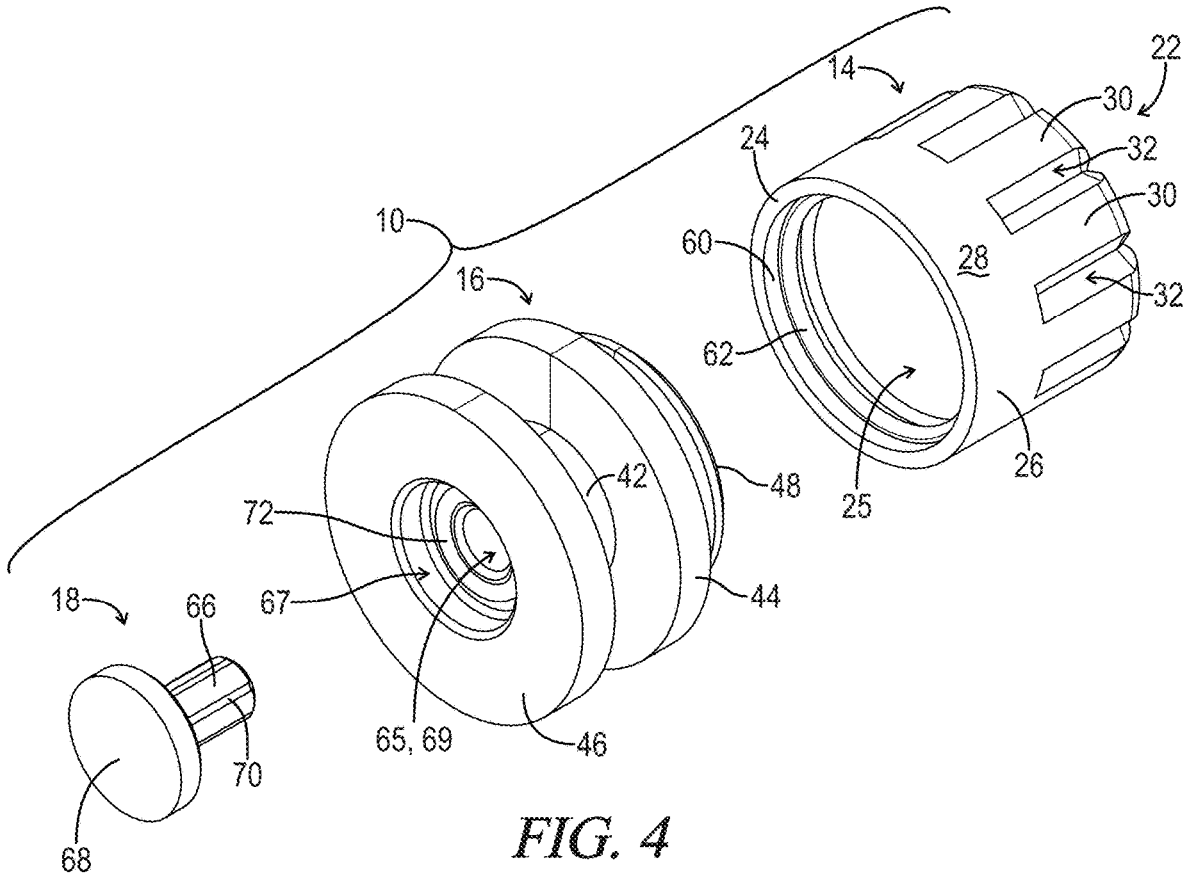
FIG. 4 is an elevated rear right side exploded perspective view of the projectile of FIG. 1. The payload contained within the interior cavity has been omitted for clarity.
Figure 5:
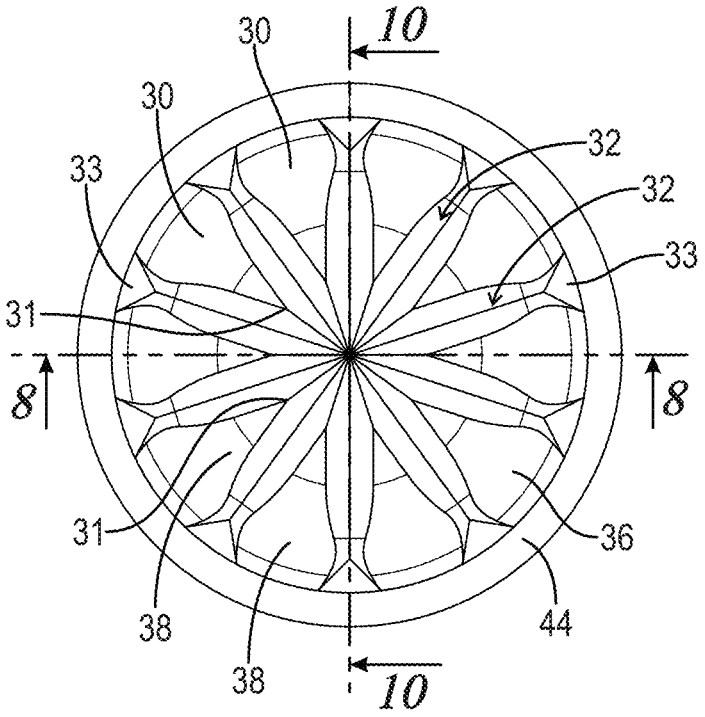
FIG. 5 front view of the projectile of FIG. 1.
Figure 6:
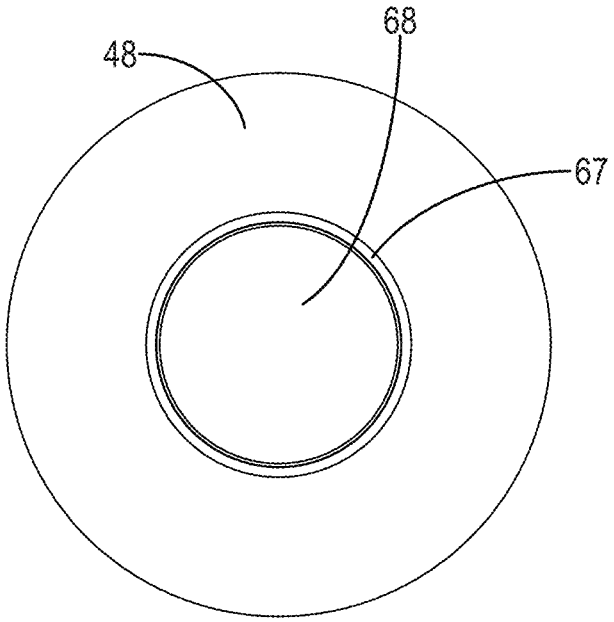
FIG. 6 is a rear view of the projectile of FIG. 1.
Figure 7:
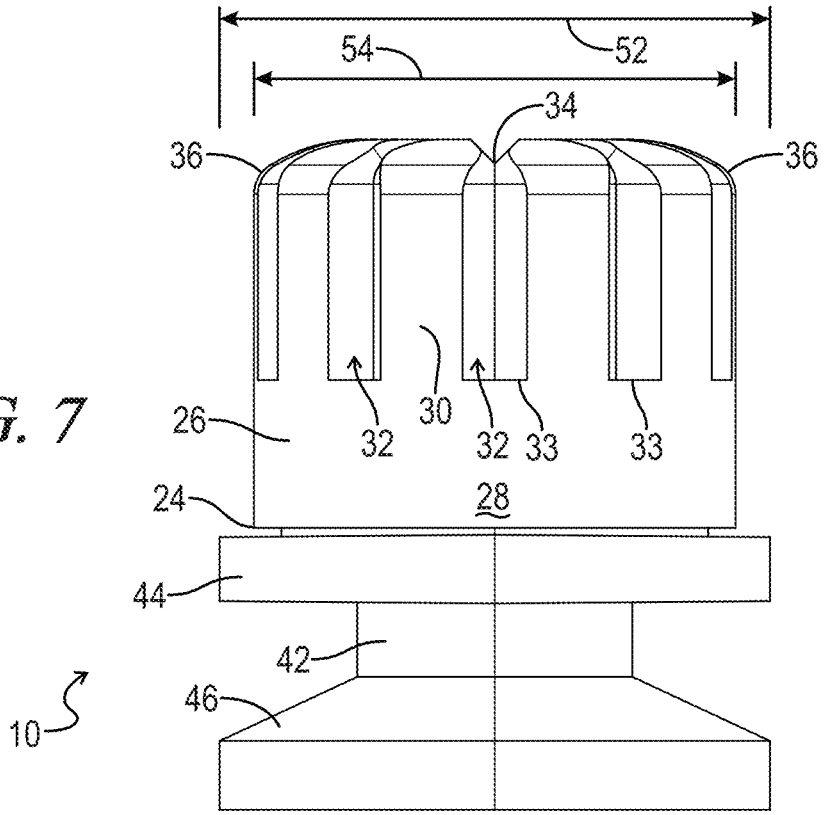
FIG. 7 is a bottom view of the projectile of FIG. 1, the top view being a mirror image thereof.
Figure 8:
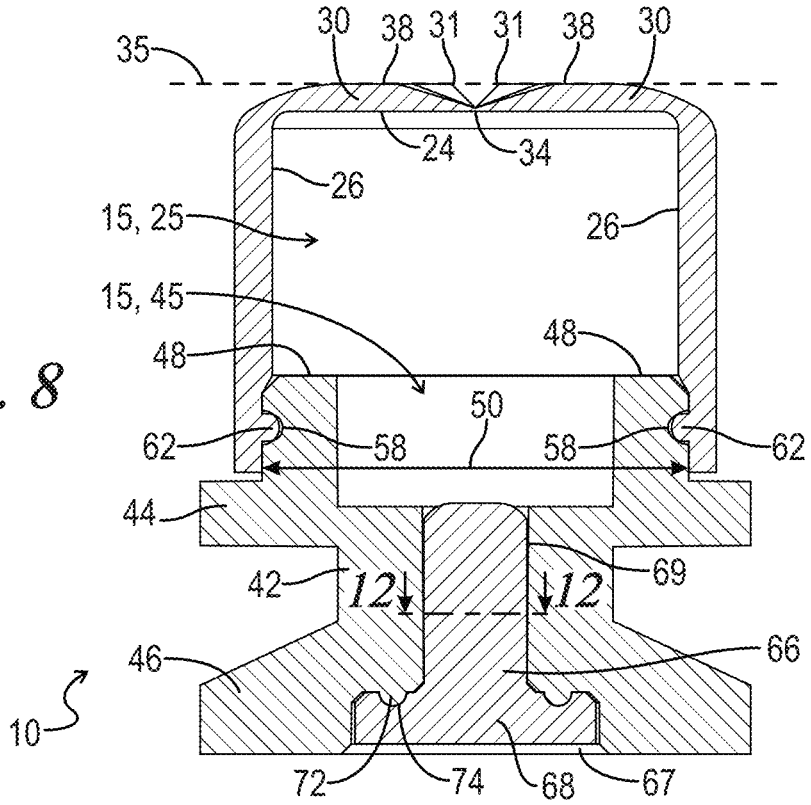
FIG. 8 is a sectional view taken along line 8-8 of FIG. 5. The payload contained within the interior cavity has been omitted for clarity.
Figure 9:
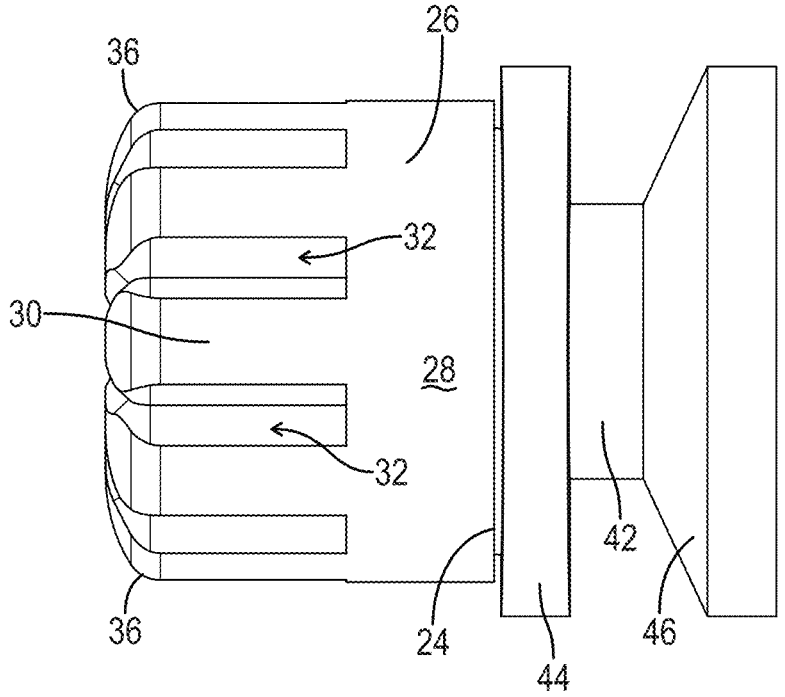
FIG. 9 is a left side view of the projectile of FIG. 1, the right side being a mirror image thereof.
Figure 10:
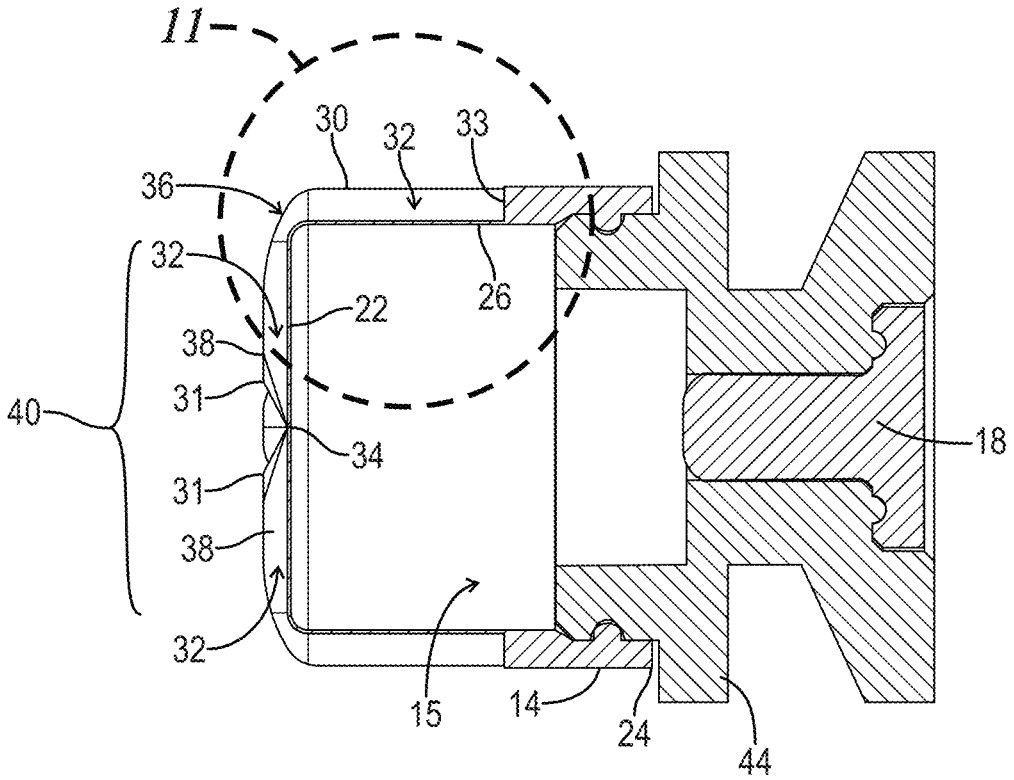
FIG. 10 is a sectional view taken along line 10-10 of FIG. 5.
Figure 11:
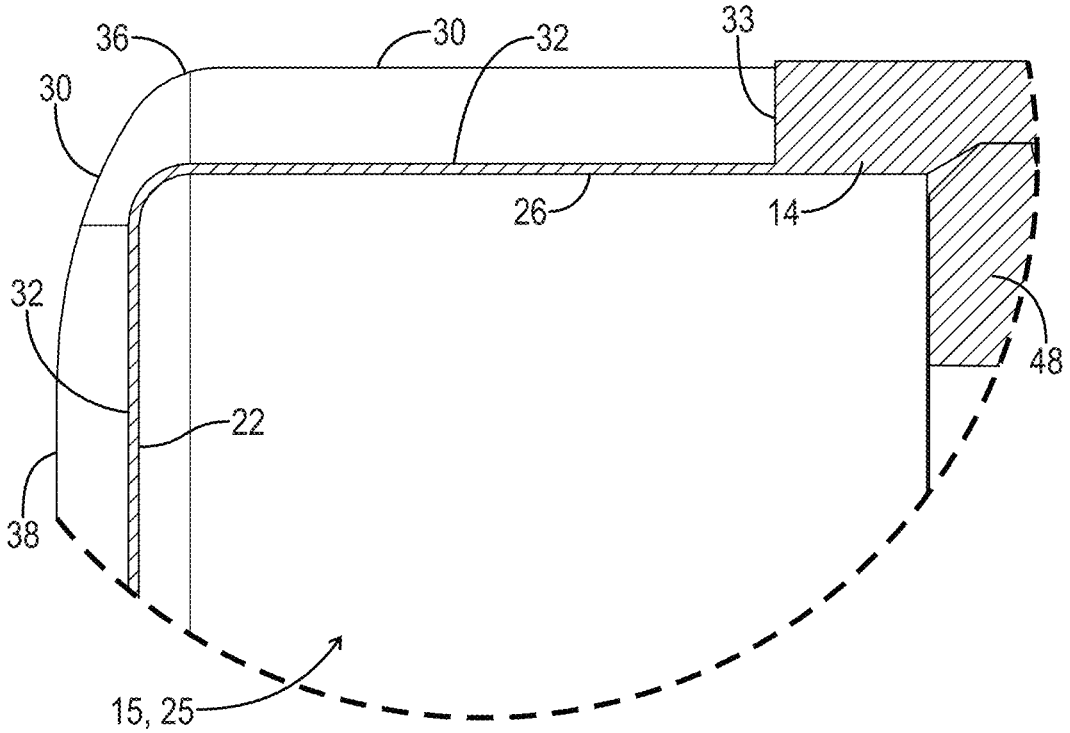
FIG. 11 is a magnified detail view of location 11 of FIG. 10. The payload contained within the interior cavity has been omitted for clarity.
Figure 12:
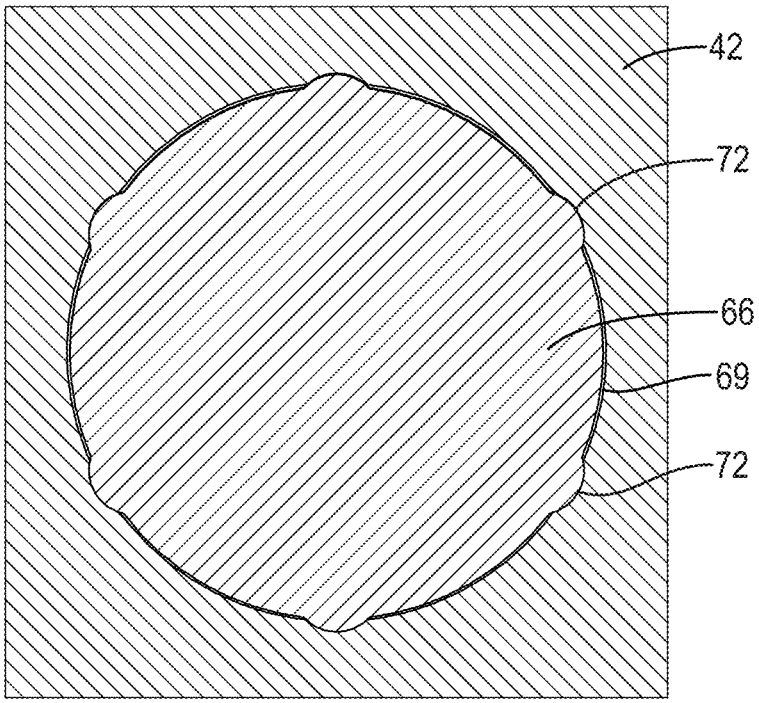
FIG. 12 is a sectional view taken along line 12-12 of FIG. 8.

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments are discussed in detail below, it should be appreciated that many applicable inventive concepts can be embodied in a wide variety of specific contexts. The specific embodiments discussed herein are merely illustrative of specific ways to make and use the invention and do not delimit the scope thereof. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the disclosure. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an "upright" position is considered to be the position of apparatus components while in proper operation or in a natural resting position as described herein. As used herein, the "upright" position of an airgun is when being supported by a user or stand in a generally level firing position (i.e., with the barrel bore level). An "upright" position of a projectile is considered to be the position when the projectile is received in the chamber of an airgun being held in the generally level firing position. As used herein, the terms "aft" and "rear" mean in a direction toward a rear end of a weapon or projectile. The terms "front" and "forward" mean in a direction extending away from the rear of the weapon or projectile toward the muzzle of the weapon or the nose of the projectile, respectively. The term "forward" can also mean forward beyond the muzzle or nose. "Vertical," "horizontal," "above," "below," "side," "top," "bottom" and other orientation terms are described with respect to this upright position during operation unless otherwise specified.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

All measurements should be understood as being modified by the term "about" regardless of whether the word "about" precedes a given measurement.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

The term "substantially" as used herein means what is considered normal or possible within the limits of applicable industry-accepted manufacturing practices and tolerances. For example, the phrase "substantially full," as used herein, means that something contains as much or as many as is normal or possible within the limits of industry accepted manufacturing practices and tolerances. Similar, the phrases "substantially fills" and "substantially filling," as used herein, means that something is made to fill or occupy as much of something else (such as a space or a container) as is normal or possible within the limits of applicable industry accepted manufacturing practices and tolerances.

Referring now to FIGS. 1-12 and 16-18, there is shown an embodiment of a precision non-shattering less-lethal projectile 10. The projectile 10 is non-spherical with an elongated shape defining a longitudinal axis 12. The projectile 10 generally includes a front portion (i.e., nose) defined by a cap 14, a rear portion (i.e., main body) defined by a base member 16, a plug 18, and a flowable payload 20. The base member 16 can have a generally collar-button or diabolo-shaped body. The base member 16 is configured to obturate (i.e., substantially seal) a barrel bore 5 of an airgun 2. The base member 16 is also configured to center and stabilize the projectile 10 as it travels down the bore 5 when fired from the airgun 2. The cap 14 is a hollow generally cylindrical body engaged with a forward end of the base member 16. The cap 14 and the base member 16 define an interior cavity 15. The flowable payload 20 is contained within the interior cavity 15. The payload 20 and substantially fills the cavity 15. The payload 20 is released from the interior cavity 15 through the cap 14 and applied to a target upon impact of the projectile 10 with the target.

The cap 14 includes a closed forward end 22, an open rear end 24, and a sidewall 26 having an exterior circumferential surface 28. The sidewall 26 extends from the forward end 22 to the rear end 24 and defines an interior space 25. The open rear end 22 of the cap 14 is engaged with the base member 16 such that the cap 16 and the base member 16 define the interior cavity 15. As explained in more detail below, the cap 14 is designed to stabilize the projectile 10 during flight toward a target (e.g., a person) and then open (i.e., rupture, split, or tear) without shattering and release the payload 20 from the cavity 15 upon impact of the projectile 10 with the target when the projectile 10 is launched from an airgun 2. The payload 20 is applied solely to the target when released from the cavity 15 because the cap 14 does not shatter or fragment, which prevents the formation of shrapnel (i.e., explosively spreading fragments) upon impact of the projectile 10 with the target. This in turn prevents the infliction of unintended damage to the eyes and other sensitive areas of the target and any surrounding bystanders, which is a well-known drawback of traditional frangible less-lethal projectiles. The projectile 10 thus enables a shooter to minimize or eliminate collateral damage by precisely applying a predetermined payload to an intended target more safely than is possible with currently available less-lethal projectiles.

More specifically, the cap 14 includes an array of alternating fins 30 and grooves 32 on the closed forward end 22 and the sidewall 26. The fins 30 and grooves 32 are arranged to simultaneously stabilize the projectile 10 during flight toward the target and facilitate controlled opening of the cap 14 and release of the payload 20 upon impact of the projectile 10 with the target. The grooves 32 define the fins 30 in that each fin 30 is defined on the cap 14 by two adjacent grooves 32. Put another way, each fin 30 is defined between a pair of adjacent grooves 32. Conversely, each groove 32 is defined on the cap 14 between a pair of adjacent fins 30. The fins 30 and grooves 32 generally extend radially from a center 34 of the forward end 22 to a periphery 36 of the forward end 22, and rearwardly from the periphery 36 along at least a portion of the exterior circumferential surface 28 of the sidewall 26. The center 34 of the forward end 22 of the cap 14 lies on the longitudinal axis 12. The longitudinal axis 12 intersects the center 34 of the forward end 22 of the cap 14.

Each groove 32 originates at the center 34 of the cap 14, while each fin 30 originates a short distance from (i.e., near) the center 34 of the cap 14. As such, each fin 30 includes an origin 31 on the forward end 22 of the cap 14. The origins 31 are the forwardmost (i.e., leading) ends of the fins 30. The origins 31 are spaced from the center 34 of the cap 14. Each fin origin 31 is a tapered point. As such, each fin 30 is narrower at the origin 31 than anywhere else along its length. Each fin 30 is relatively wider at a rearmost terminal end 33. Each fin 30 is widest at the periphery 36 of the forward end 22 of the cap 14. The fins 30 and grooves 32 can extend over half the length of the cap 14 along the sidewall 26 from the periphery 36. The fins 30 and grooves 32 extend along the exterior circumferential surface 28 of the sidewall 26 parallel to the longitudinal axis 12. Each groove 32 extending along the sidewall 26 of the cap 14 is parallel to each adjacent (i.e., neighboring) groove 32. Each fin 30 extending along the sidewall 26 of the cap 14 is parallel to each adjacent fin 30. Each fin 30 and groove 32 extends along the sidewall 26 of the cap 14 from the periphery 36 to a terminal end 33. Because the grooves 32 define the fins 30 (and vice/versa), the terminal end 33 of each fin 30 is coterminous with the terminal end 33 of each groove 32. As such, the terminal ends 33 of the fins 30 and grooves 32 can all be spaced the same distance along the sidewall 26 from the rear end 24 of the cap 14.

The fins 30 stabilize the projectile 10 during flight by channeling air through the groove 32 between each pair of adjacent fins 30. The fins 30 and grooves 32 facilitate controlled opening of the cap 14 and release of the payload 20 by causing the cap 14 to tear or split along one or more grooves 32 upon impact. To prevent the cap 14 from shattering on impact and control the path or pattern along which the cap 14 opens upon impact, each groove 32 has a V-shaped cross section. Grooves 32 with sharp V-shaped cross sections weaken the cap 14 in predetermined areas by thinning the material of the cap 14 along the bottom of each groove 32. This dictates the path along which the cap 14 splits when a suitable force is applied thereto. As such, the forward end 22 and sidewall 26 of the cap 14 have a uniform thickness along a bottom of each groove 32. The thickness of the forward end 22 and sidewall 26 along the bottom of each groove 32 is less than the thickness of each fin 32 anywhere on the forward end 22 or sidewall 26 of the cap 14. In this way, each groove 32 defines a weakened area or line of weakness in the cap 14 along which the cap can open upon impact when fired from an airgun 2.

To further ensure that the cap 14 breaks along one or more grooves upon impact, each fin 30 also defines an impact surface 38. The impact surfaces 38 are the leading surfaces of the fins 30. The impact surfaces 38 are arranged to contact the target before any other portion of the projectile 10 so that impacting the target with a projectile 10 applies a force to the fins 30 at the impact surfaces 38. Continued forward motion of the projectile 10 during impact causes the fins 30 to deform inwardly (i.e., toward the interior cavity 15). This in turn causes the cap 14 to expand and rip, tear, or split along one or more grooves 32, thereby opening the center 34 but not shattering the cap 14 into a plurality of fragments while safely and reliably releasing the payload 22 from the interior cavity 15 and applying it to the target.

The impact surfaces 38 are spaced a common distance radially outward from the center 34 of the closed forward end 22 of the cap 14. Each impact surface 38 extends distally from the respective fin origin 31 toward the periphery 36 of the forward end 22 of the cap 14. The center 34 of the forward end 22 of the cap is recessed from a reference plane 35 containing the impact surfaces 38. In this way, the impact surfaces 38 are configured to contact the target before any other portion of the projectile 10, including the center 34 of the cap 14. As such, the impact surfaces 38 of the fins 30, in conjunction with the grooves 32 between each pair of adjacent fins 30, collectively define a serrated concave meplat 40 on the closed forward end 22 of the cap 14 configured to open but not shatter the cap 14 upon impact of the projectile 10 with the target. Impacting the meplat (i.e., the impact surfaces of the fins) with the target causes the cap to rupture (i.e., tear) along the grooves 32 without explosively shattering the cap 14 into rapidly expanding fragments. As discussed more below, the constituent material from which the cap 14 is formed can further discourage fragmentation.

The base member 16 includes a waist in the form of a short cylindrical trunk 42, a head in the form of an annular flange 44 at a forward end of the trunk 42, and a tail in the form of a skirt 46 spaced from the flange 44 at a rear end of the trunk 42. The trunk 42 defines the longitudinal axis 12 of the projectile 10. An annular protrusion 48 is formed on a forward surface of the flange 44. The annular protrusion 48 is formed on a side of the flange 44 opposite the trunk 42. The annular protrusion 48 has a diameter 50 less than a diameter 52 of the flange 44. The diameter 50 of the annular protrusion 48 is also less than a diameter 54 of the cap 14. The annular protrusion is received in the interior space 25 of the cap 14. The cap 14 is on a side of the flange 44 opposite the trunk 42. The annular protrusion 48 defines a seat with which the cap 14 is engaged. The cap 14 is engaged with the annular protrusion 48 via an interference fit. The annular protrusion 48 defines an interior space 45 which forms a part of the interior cavity 15 in which the flowable payload 20 is received.

The annular protrusion 48 includes an exterior surface 56. An annular channel 58 is defined in the exterior surface 56. The open rear end 24 of the cap 14 includes an interior surface 60. An annular ridge 62 protrudes centripetally from the interior surface 60. The annular ridge 62 is received in the channel 58. The annular ridge 62 is sized and shaped to retain the cap 14 on the annular protrusion 48 of the base member 16 when the ridge 62 is received in the channel 58. The ridge 62 and channel 58 also help maintain the cap 14 and the annular protrusion 48 in a sealing engagement. This ensures that the flowable payload 20 remains in the interior cavity 15 until impact of the projectile with a target. In other embodiments, the ridge 62 can be formed on the exterior surface 56 of the annular protrusion 48, and the channel 58 can be formed in the interior surface 60 of the open rear end 24 of the cap 14.

The diameter 54 of the cap 14 is less than the diameter 52 of the flange 44. The diameter 52 of the flange 44 is sized so as to ride on the rifling lands 7 defined between grooves 9 inside the barrel bore 5 of the airgun 2. In this way, the flange 44 is configured to center and stabilize the projectile 10 during travel down the bore 5 of the barrel 4 when fired from the airgun 2 while preventing the nose or cap 14 from contacting the rifling. This both increases accuracy of the projectile 10 and prevents the cap 14 from inadvertently opening in the barrel 4 of the airgun 2.

The base member 16 further includes a fill aperture 65. The fill aperture 65 is in fluid communication with the interior cavity 15 through the interior space 45 of the annular protrusion 48. The fill aperture 65 includes a wide mouth 67 and a relatively narrower passage 69. The mouth is formed in the skirt 46 at the rear of the base member 16. The passage 69 extends through the skirt 46, the trunk 42, and the flange 44 to the interior space 45 of the annular protrusion 48. As such, the fill aperture 65 extends through the base member 16 from a rear end of the skirt 46 to a forward surface of the flange 44 such that the fill aperture 65 is in fluid communication with the interior space 45 of the annular protrusion 48 and thus the larger interior cavity 15. The fill aperture 65 extends through the base member 16 coaxially with the longitudinal axis 12. The flowable payload 20 is filled into the interior cavity 15 through the fill aperture 65 when the cap 14 is engaged with the annular protrusion 48 of the base member 16. This arrangement increases projectile stability during flight by eliminating empty space inside the interior cavity 15. Elimination of empty space inside the interior cavity 15 prevents the formation of a bubble which can move around the interior cavity 15 and thereby unbalance the projectile 10 during projectile flight toward a target.

The plug 18 is received in and closes the fill aperture 65. The plug 18 includes a plug stem 66 and a plug head 68. The plug stem 66 is received in and seals the passage 69 of the fill aperture 65. The plug head is received in and seals the mouth 67 the fill aperture 65. The plug includes a plurality of crush ribs 70 extending longitudinally along the length of the plug stem 66. The plug 18 seals the fill aperture 65 in an interference fit. The crush ribs 70 support and improve the stability of the connection between the plug 18 and the fill aperture 65. The plug 18 seals the payload 20 within the cavity 15 and thereby prevents the payload 20 from exiting the cavity 15 through the fill aperture 65. The plug head 68 is recessed from the rearmost surface of the projectile 10 such that the rear end of the skirt 46 is at least partially concave. This can aid the skirt 46 in obturating the barrel bore 5 when the projectile 10 is fired from an airgun 2, much like the hollow skirt of a traditional metal diabolo pellet. This arrangement also simultaneously ensures that the plug 18 cannot become dislodged or unsealed from the fill aperture 65 because high pressure gas provided by the airgun upon firing pushes the plug 18 into (i.e., toward) the fill aperture 65 as it pushed the projectile 10 down and out of the barrel bore 5. The width of the plug head 68 helps prevent the high pressure gas from blowing the plug 18 out through the fill aperture 65. The relative position of the plug head 68 in the mouth 67 of the fill aperture 65 is also maintained by specially adapted mating geometries of the mouth 67 and the plug head 68.

Specifically, the mouth 67 of the fill aperture 65 includes a rearwardly protruding annular rim 72, while the forward surface of the plug head 68 includes an annular depression 74 in which the rim 72 is received. When the airgun 2 is fired, a high-pressure gas is provided to the rear of the projectile 10. This applies a force to the plug 18 at the plug head 68 which, depending on the pressure (i.e., PSI) of the gas provided, could blow the plug head 68 forward through the fill aperture 65. The rim 72 and depression 74 reinforce the plug head 68 to eliminate this possibility. The forward force applied to the rear of the plug head causes the rim 72 to strongly engage the depression 74. The constituent material of the skirt 46, and thus the depression 74, is strong enough to withstand that force. This enables the depression 74 to apply a retaining force on the rim 72, which holds the plug head 68 in place at the mouth 67 of the fill aperture 65, and maintains the seal on the interior cavity 15.

The cap 14, base member 16, and plug 18 can be made of any desirable non-metallic material, such as one or more synthetic or natural polymers. In one embodiment, the base member 16 is formed from a first polymeric material, while the cap 14 and plug 18 are formed from a second different polymeric material. The first polymeric material has a density greater than the density of the second polymeric material. In one embodiment, the first material is a 50% glass fiber reinforced, heat stabilized, electrically neutral polyamide 6 (e.g., nylon 6), and the second material is a low-density polyethylene. Formation of the base member 16 from a material having a greater density than the material from which the cap 14 and plug 18 are formed helps balance the projectile 10 by defining a center of mass disposed at a forwardly location along the longitudinal axis that prevents the projectile 10 from oscillating or tumbling during flight when the projectile 10 is launched from an airgun 2. This greatly improves projectile stability during flight. Formation of the cap 14 (including the fins thereof) from a soft or deformable, flexible polymeric material such as low-density polyethylene also aids in the prevention of shrapnel by deterring fragmentation and instead encouraging tearing of the cap along one or more grooves.

The flowable payload 20 can be any material capable of flowing or being flowed, including but not limited to a liquid, a gel, an aerosol, or a granular or particulate material, such as a powder. For example, the payload 20 can be a powder containing an irritant such as capsaicin, oleoresin *capsicum*, pelargonic acid vanillylamide (PAVA), and the like, or analogs or derivatives thereof. Alternatively, the payload 20 can be a liquid containing an irritant and/or a colorant, such as a paint or an ultraviolet light-activated dye or marker substance. In other embodiments, the payload 20 can be an inert, non-irritant chalk or talcum powder, or a metal powder, such as powdered tungsten, steel, or copper. In additional embodiments, the payload 20 can include a liquid such as a paint or a dye, and a particulate substance, such as sand.

It is to be understood that in some embodiments, the payload 20 be formed from a solid (i.e., non-flowable) material (instead of a flowable material) so that projectile 10 functions as a pure kinetic impact projectile. For example, in some embodiments, the payload 20 can be a solid, dense slug of a material selected to deliver a hard but non-penetrating kinetic impact to a target. Suitable solid substances include metallic materials, such as tungsten and steel, or dense polymeric materials, such as rubber. It should also be understood that in such embodiments, the interior space 25 of the cap 14 can be filled with a monolithic slug of the selected solid payload material before the cap 14 is attached to the base member 16. In still yet other embodiments, the cap 14 itself can be solid and non-hollow. In such embodiments, the interior space 25 of the cap 14 can be filled with the same constituent material from which the forward end 22 and sidewall 26 are formed. In certain embodiments incorporating a non-flowable payload made from a solid material, the fill aperture 65, plug 18, and interior space 45 of the annular protrusion 48 can be omitted from the projectile 10 as these structures exist in part to provide a mechanism through which the interior cavity 15 can be filled with a flowable payload 20.

Figure 13:
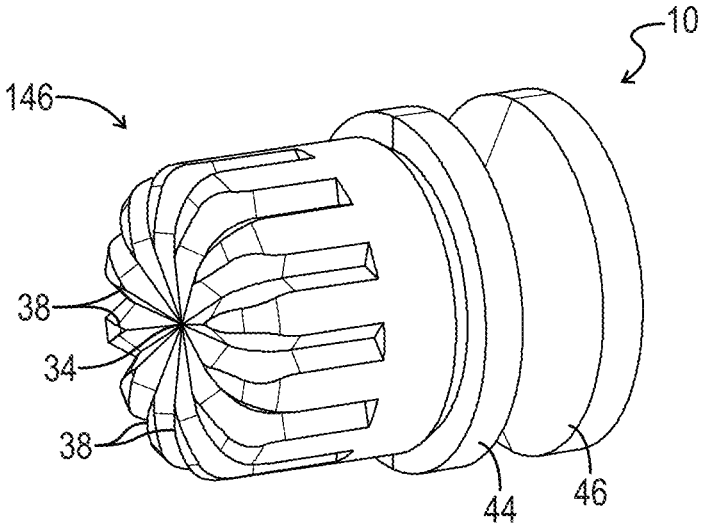
FIG. 13 is an elevated front left side perspective view of another embodiment of a precision non-shattering projectile constructed in accordance with the present invention.
Figure 14:
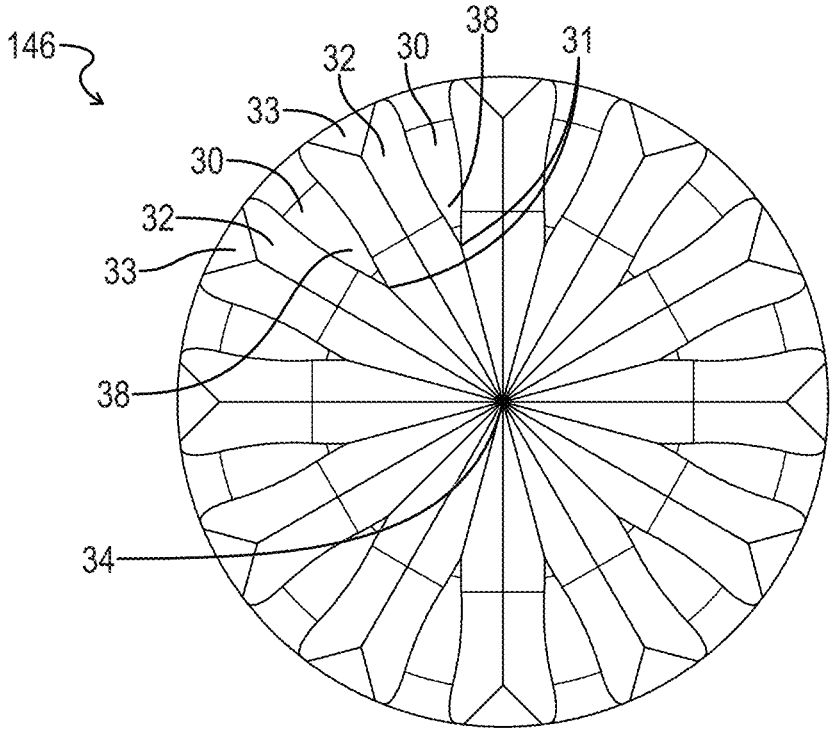
FIG. 14 is a front view of the cap of the projectile of FIG. 13 in isolation.
Figure 15:
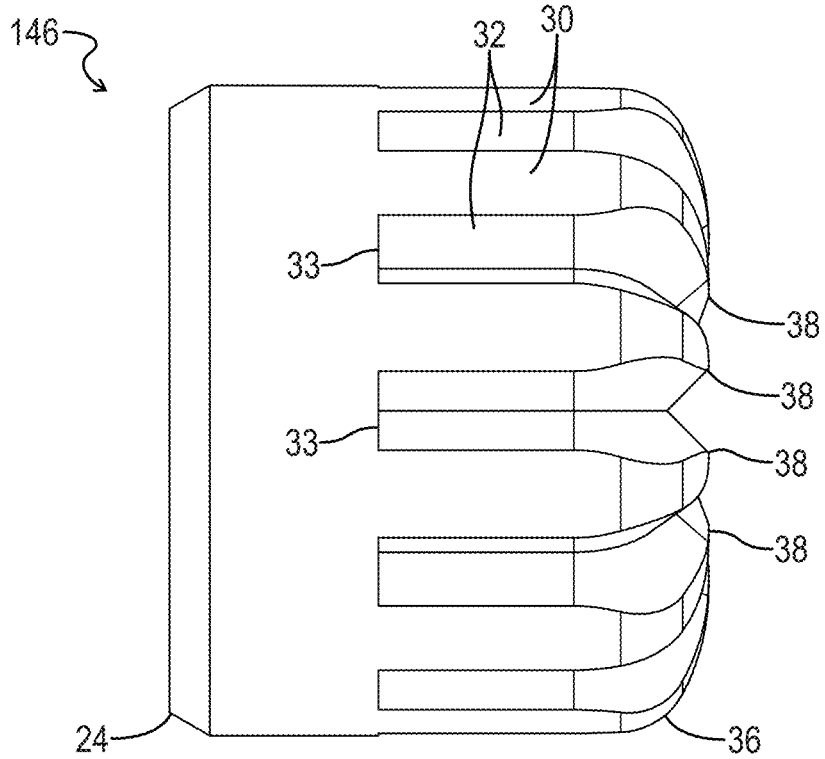
FIG. 15 is a right side view of the cap of FIG. 14.
Figure 16:
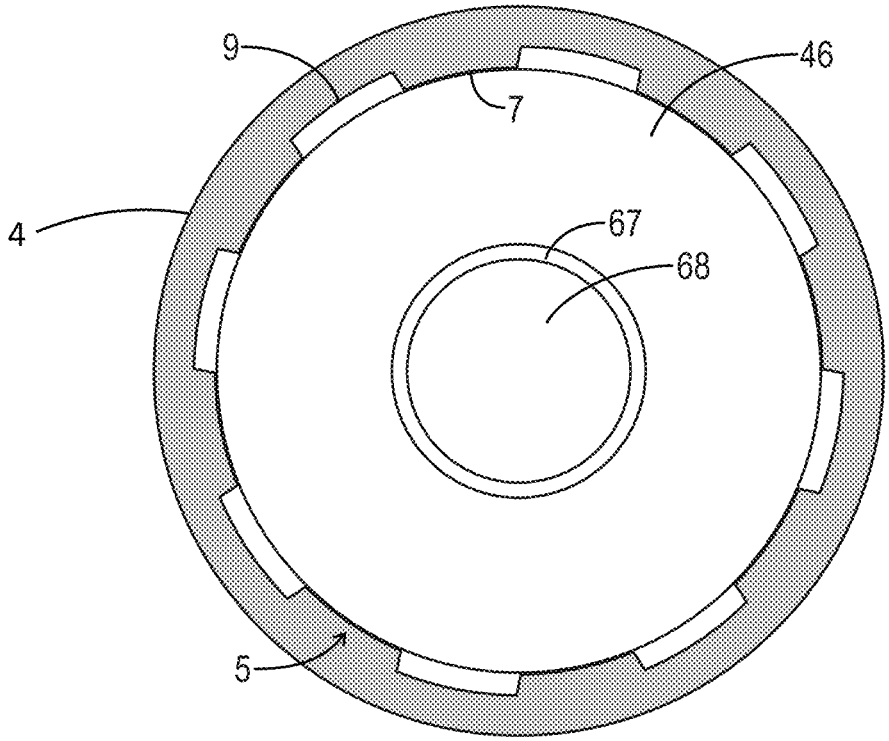
FIG. 16 is a schematic sectional view of an exemplar airgun barrel depicting the projectile of FIG. 1 received in the bore prior to discharge of the airgun.
Figure 17:
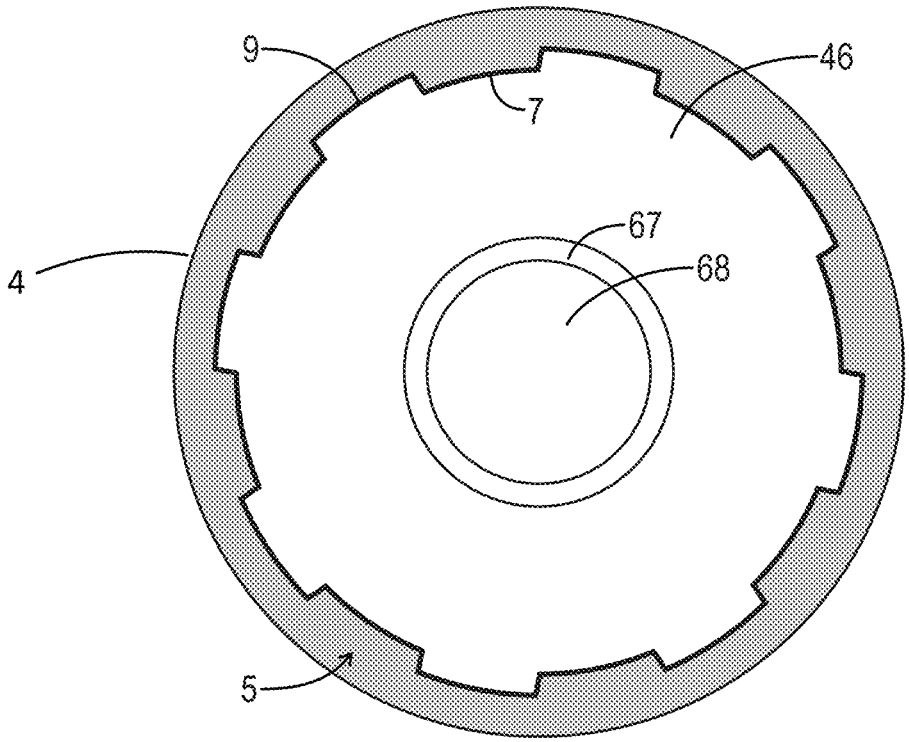
FIG. 17 is a schematic sectional view of an exemplar airgun barrel depicting the projectile of FIG. 1 obturating the bore upon discharge of the airgun.
Figure 18:
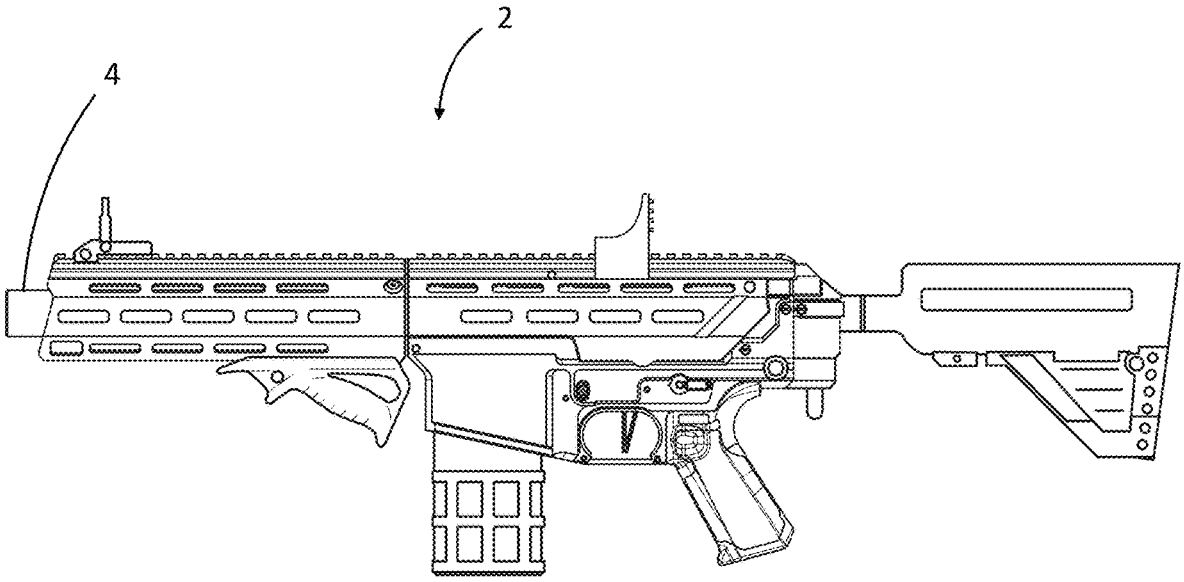
FIG. 18 is a side view of the airgun of FIG. 16.

Referring now to FIGS. 13-15, there is shown another embodiment of a cap 14*b* for a precision non-shattering less-lethal projectile 10. The cap 14*b* is identical in all respects to cap 14 except as specifically described hereinafter or depicted in the figures. Specifically, the impact surfaces 38 of the fins 30 on cap 14*b* are spaced distally from the origin 31 of each fin 30. The origin 31 of each fin 30 is also recessed relative to the respective impact surface 38. Each fin 30 is wider at the periphery 36 of the forward end 22 of the cap 14 than at the origin 31, but narrower at the periphery 36 that at the terminal end 33. As such, each fin 30 is widest at the rearmost terminal end 33. Cap 14*b* also includes more fins 30 and grooves 32 than does cap 14.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments described herein it is not intended that such references be construed as limitations upon the scope thereof except as set forth in the following claims.

What is claimed is:

1. An airgun, comprising:

a barrel defining a bore; and a less-lethal projectile receivable in the bore, the projectile comprising:

a rear portion configured to obturate the bore; and a hollow cylindrical cap having a closed forward end, an open rear end, and a sidewall extending from the closed forward end to the open rear end; wherein:

the open rear end of the cap is sealingly engaged with the rear portion of the projectile such that the cap and the rear portion of the projectile define an interior cavity in which a flowable payload is receivable;

the cap defines a plurality of grooves extending radially from a center of the forward end and rearwardly from the forward end along an exterior surface of the sidewall such that the plurality of grooves defines a plurality of fins, each fin defined by two adjacent grooves of the plurality of grooves; and the cap is configured to release the payload from the cavity without shattering upon impact of the projectile with a target.

2. The airgun of claim 1, wherein the forward end and sidewall of the cap have a uniform thickness along a bottom of each groove such that each groove defines a line of weakness along which the cap can tear upon impact.

3. The airgun of claim 1, wherein the fins are configured to impact the target before the center of the cap such that impact of the fins with the target causes the cap to split along at least one groove.

4. The airgun of claim 1, wherein:

each fin of the plurality of fins defines an impact surface; and the impact surfaces collectively define on the forward end of the cap a serrated concave meplat configured to split the cap along at least one of the grooves upon impact of the projectile with the target.

5. The airgun of claim 1, wherein each groove of the plurality of grooves has a V-shaped cross section.

6. The airgun of claim 1, wherein:

the rear portion of the projectile is a base member defining a longitudinal axis and including a waist, a head at a forward end of the waist, and a skirt at a rear end of the waist; and the cap is on the head opposite the waist.

7. The airgun of claim 6, wherein:

the waist is a cylindrical trunk defining the longitudinal axis;

the head is a flange at a forward end of the trunk; and the skirt is spaced from the flange at a rear end of the trunk.

8. The airgun of claim 6, wherein the head includes an annular protrusion with which the cap is engaged.

9. The airgun of claim 8, wherein:

the annular protrusion includes a circumferential channel defined in an exterior surface thereof, and the rear open end of the cap includes a centripetally protruding annular ridge received in the channel; or the rear open end of the cap includes a circumferential channel defined in an interior surface thereof, and the annular protrusion includes a radially protruding annular ridge received in the channel.

10. The airgun of claim 6, wherein:

the head has a first diameter;

the cap has a second diameter; and the second diameter is less than the first diameter.

11. The airgun of claim 6, further comprising:

a fill aperture extending through the base member, the fill aperture in fluid communication with the cavity; and a plug receivable in the fill aperture to seal the payload within the cavity.

12. The airgun of claim 6, wherein:

the base member is formed from a first polymeric material;

the cap is formed from a second polymeric material; and the first polymeric material has a density greater than the second polymeric material.

13. The airgun of claim 6, wherein the projectile is configured to define a center of mass disposed at a location along the longitudinal axis that prevents the projectile from oscillating or tumbling during flight toward the target.

14. The airgun of claim 1, further comprising:

a fill aperture through which the payload is receivable into the cavity; and a plug receivable in the fill aperture to seal the payload within the cavity.

15. An airgun, comprising:

a barrel defining a bore; and a less-lethal projectile received in the bore, the projectile comprising:

a polymeric base member including a cylindrical trunk defining a longitudinal axis, a flange at a forward end of the trunk, a skirt at a rear end of the trunk, and a fill aperture extending through the base member coaxially with the longitudinal axis;

a polymeric hollow cylindrical cap having a closed forward end, an open rear end sealingly engaged with the flange such that the cap at least partially defines an interior cavity, a sidewall extending from the forward end to the open rear end, a plurality of grooves extending radially from a center of the forward end and rearwardly from the forward end along the sidewall such that the plurality of grooves defines a plurality of fins, each fin defined by two adjacent grooves of the plurality of grooves;

a flowable payload received in the cavity; and a plug configured to seal the payload in the cavity received in the fill aperture;

wherein the fins are configured to impact the target before the center of the forward end of the cap such that impact of the fins with the target causes the cap to split along at least one groove.

16. The airgun of claim 15, wherein:

each fin of the plurality of fins defines an impact surface on the forward end of the cap;

the center of the cap is recessed from the impact surfaces; and the impact surfaces collectively define a serrated concave meplat on the forward end of the cap.

17. The airgun of claim 15, the plug includes a plug stem and a plug head;

the fill aperture includes a mouth at a rear end of the projectile and a relatively narrower passage extending from the mouth through the trunk to the cavity;

the plug stem is received in the passage;

the plug head is received in the mouth;

the plug head is recessed from the rear end of the projectile such that a rear end of the skirt is at least partially concave.

18. The airgun of claim 15, wherein the projectile is configured to define a center of mass disposed at a location along the longitudinal axis that prevents the projectile from oscillating or tumbling during flight toward the target.

19. An airgun, comprising:

a barrel defining a bore; and a less-lethal projectile receivable in the bore, the projectile comprising:

a base member formed from a first polymeric material, the base member configured to obturate the bore; and a hollow cylindrical cap formed from a second polymeric material, the cap having a closed forward end, an open rear end, and a sidewall extending from the closed forward end to the open rear end; wherein:

the open rear end of the cap is sealingly engaged with the base member such that the cap and the base member define an interior cavity in which a flowable payload is receivable;

the first polymeric material has a density greater than the second polymeric material;

the cap defines a plurality of grooves extending radially from a center of the forward end and rearwardly from the forward end along an exterior surface of the sidewall such that the plurality of grooves defines a plurality of fins, each fin defined by two adjacent grooves of the plurality of grooves; and the cap is configured to release the payload from the cavity without shattering upon impact of the projectile with a target.

* * * * *